United States Patent [19]

Mori et al.

[11] 4,256,234

[45] Mar. 17, 1981

[54] CONTAINER CLOSURE HAVING EASILY OPENABLE LINER COMPRISED OF BASE RESIN, LUBRICANT AND 1 TO 15% BY WEIGHT OF A CONJUGATED DIENE RESIN

[75] Inventors: Fumio Mori, Yokohama; Junichi Itsubo, Hiratsuka; Gunji Matsuda, Isehara; Shigeru Nagashima; Kozo Nakamura, both of Hiratsuka, all of Japan

[73] Assignee: Japan Crown Cork Co. Ltd., Tokyo, Japan

[21] Appl. No.: 964,883

[22] Filed: Nov. 30, 1978

[51] Int. Cl.[3] ..... B65P 53/00; C08L 23/16

[52] U.S. Cl. ..... 215/343; 260/32.6 A; 525/95

[58] Field of Search ..... 525/95; 260/32.6 A; 215/343

[56] References Cited

U.S. PATENT DOCUMENTS

| | | | |
|---|---|---|---|
| 3,478,128 | 11/1969 | Hegemeyer | 525/95 |
| 3,515,528 | 6/1970 | Juther et al. | 260/32.6 A |
| 3,563,402 | 2/1971 | Arnold et al. | 215/341 |
| 4,010,128 | 3/1977 | Saggese et al. | 525/95 |
| 4,112,158 | 9/1978 | Creekmore et al. | 525/98 |
| 4,126,662 | 11/1978 | Middlebrook | 525/98 |

FOREIGN PATENT DOCUMENTS

| | | | |
|---|---|---|---|
| 1196125 | 6/1970 | United Kingdom | 525/98 |

*Primary Examiner*—Joseph L. Schofer
*Assistant Examiner*—Peter F. Kulkosky
*Attorney, Agent, or Firm*—Sherman & Shalloway

[57] ABSTRACT

Container closure having an easily openable liner, said liner being composed of a composition comprising a base resin consisting of 95 to 30% by weight of a crystalline polyolefin and 5 to 70% by weight of a lowly crystalline or amorphous copolymer of ethylene with otherolefin, a lubricant in an amount of 0.001 to 5% by weight based on said base resin and a polymer containing at least 10% by weight of a conjugated diene in an amount of 1 to 15% by weight based on said base resin. This closure has a good sealing property and an easy openability in combination.

7 Claims, 4 Drawing Figures

CONTAINER CLOSURE HAVING EASILY OPENABLE LINER COMPRISED OF BASE RESIN, LUBRICANT AND 1 TO 15% BY WEIGHT OF A CONJUGATED DIENE RESIN

This invention relates to a container closure having an olefin resin liner. More particularly, the invention relates to a container closure having a liner of an olefin resin composition excellent in the sealing property and easy openability.

Olefin resins such as low density polyethylene have an appropriate cushioning property and an excellent sanitary characteristic in combination, and they are broadly used as sealing liners of container closures. However, it has been found that when olefin resin liners are applied to container closures, various troubles are caused. For example, when a container closure having an olefin resin liner is clamped to the mouth of a container and the container is stored for a long time, the torque necessary for opening the container closure is increased with the lapse of time and it is often difficult for a purchaser to open the container by hand.

It may be considered that if a lubricant is incorporated into an olefin resin constituting th liner, the torque necessary for opening the container will be decreased. In this case, however, the lubricant incorporated into the olefin resin immigrates to the surface portion of the liner, and there is caused a defect that the torque is excessively low in the initial stage of sealing. More specifically, when the torque in the initial stage of sealing is extremely low in case of a screwed container closure or the like, insufficient sealing takes place in the initial stage of clamping or the closure is readily turned and loosened during the post treatment or transportation of the container. As a result, leakage of the content or intrusion of atmospheric oxygen is caused.

It is therefore a primary object of this invention to provide a container closure having an olefin resin liner, which has a good sealing property and an easy openability in combination.

Another object of this invention is to provide a container closure having an olefin resin liner, in which a torque sufficient to ensure a high sealing property is attained in the initial stage of sealing, abnormal increase of the opening torque is controlled even if the container is stored for a long time and the container can easily be opened even after long time storage.

Still another object of this invention is to provide a container closure having a liner composed of a novel olefin resin composition, in which rapid immigration of a lubricant to the surface portion of the liner is controlled and increase of the opening torque with the lapse of time is effectively prevented.

In accordance with this invention, there is provided a container closure having an easily openable liner, said liner being composed of a composition comprising a base resin consisting of 95 to 30% by weight of a crystalline polyolefin and 5 to 70% by weight of a lowly crystalline or amorphous copolymer of ethylene with other olefin, a lubricant in an amount of 0.001 to 5% by weight based on said base resin and a polymer containing at least 10% by weight of a conjugated diene in an amount of 1 to 15% by weight based on the base resin.

For a fuller understanding of the nature and advantages of the invention, reference should be had to the following detailed description taken in connection with the accompanying drawing, in which.

Figure 1:
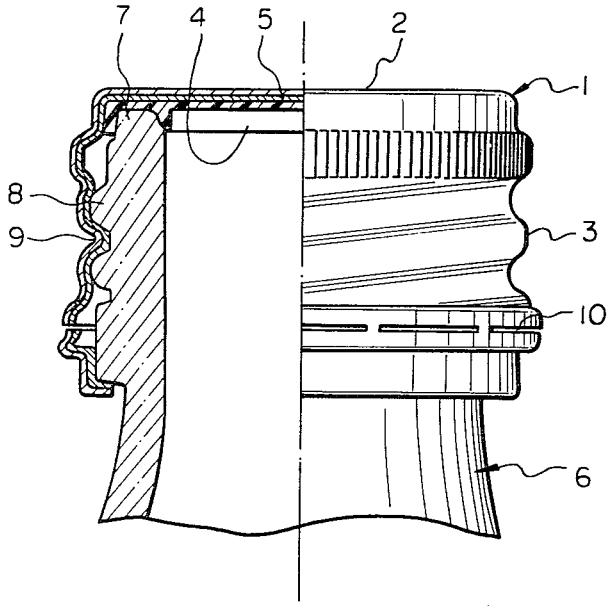
FIG. 1 is a partially sectional side view illustrating the container closure of this invention engaged with the mouth of a container.

Referring to FIG. 1 illustrating the container closure of this invention together with the mouth of a container, a container closure shell 1 is formed from a coated metal plate and comprises a disc-like top plate 2 and a cylindrical skirt 2 hanging down from the periphery of the top plate 2. A disc-like liner 4 composed of an olefin resin composition is formed on the lower side of the top plate 2 through an adhesive layer 5 on the inside of the shell 1 of the container closure.

A sealing structure to be engaged with a circular mouth 7 of a container 6 is formed on the periphery of the liner 4, and an opening and re-sealing screw 9 is formed on the skirt 3 of the shell 1 so that the screw 9 is engaged with a screw 8 formed on the neck of the container. A known pilfer-proof mechanism having a perforation 10 may be formed on the skirt 3 in the vicinity of the lower edge thereof.

One of the important features of this invention is that this liner 4 is formed from the above-mentioned novel olefin composition comprising a crystalline polyolefin, a lowly crystalline or amorphous ethylene copolymer, a lubricant and a conjugated diene-containing polymer at a specific ratio.

In order to control increase of the opening torque with the lapse of time, it is important to use a liner-forming base resin comprising (A) a crystalline polyolefin and (B) a lowly crystalline or amorphous copolymer of ethylene with other olefin at an (A)/(B) weight ratio ranging from 95/5 to 30/70, preferably from 92/8 to 70/30, especially preferably from 90/10 to 80/20.

When the lowly crystalline or amorphous ethylene copolymer (B) is used in combination with the crystalline polyolefin (A) for formation of a liner, it exerts a peculiar function of controlling increase of the opening torque with the lapse of time in a container closure having a liner. This effect cannot be attained at all by any of other amorphous polymers such as natural rubbers, polybutadiene, styrene-butadiene copolymer rubbers, nitrile-butadiene copolymer rubbers and butyl rubbers.

Further, when the lowly crystalline or amorphous ethylene copolymer is incorporated into a crystalline polyolefin, the adhesiveness of the resulting liner to the top plate of the shell of a container closure is improved, and the softness or cushioning property of the liner is further improved.

In this invention, as the crystalline polyolefin, there is used a polymer having a degree of crystallization of at least 40% and being composed of at least one olefin represented by the following formula:

$$CH_2{=}\underset{\underset{R}{|}}{CH}$$

wherein R stands for a hydrogen atom or an alkyl group having up to 4 carbon atoms.

In this invention, polyethylene and polypropylene having a degree of crystallization of at least 40% are preferably employed as such crystalline polyolefin. Other olefin may be included as a comonomer in such polyolefin in a small amount not degrading the crystallinity of the polyolefin. For example, there can be used a crystalline ethylene copolymer containing 1 to 5 mole % of propylene, butene-1 or the like with the balance being ethylene. The molecular weight of the crystalline polyolefin is not particularly critical so far as the polyolefin has a film-forming molecular weight. A crystalline polyolefin most suitable for attaining the objects of this invention is low density polyethylene having a melt index (MI) of from 3 to 10.

In the instant specification and claims, the degree of crystallization is one determined according to the X-ray diffraction method proposed by S. L. Aggarwal and G. D. Tilley in J. Polymer Sci., 18, pages 17–26, 1955.

In this invention, as the lowly crystalline or amorphous ethylene copolymer, there can be used a copolymer of ethylene with other olefin having a degree of crystallization lower than 39%, especially lower than 10%.

As suitable examples of the olefin other than ethylene, there can be mentioned propylene and butene-1. The copolymer may further comprise a non-conjugated diene such as 1,4-hexadiene or ethylidene-norbornene. Suitable examples of the ethylene copolymer include copolymers comprising 95 to 40 mole % of ethylene, 5 to 60 mole % of propylene or butene-1 and optionally 1 to 5 mole % of a non-conjugated diene, particularly ethylene-propylene copolymer rubbers and ethylene-propylene-diene terpolymer rubbers. The molecular weight of the ethylene copolymer is ordinarily in the range of from 5,000 to 2,000,000, especially from 10,000 to 1,000,000.

In this invention, it is important that this ethylene copolymer should be incorporated into the crystalline polyolefin in the above-mentioned specific amount. When the amount of the ethylene copolymer is too small, the effect of controlling increase of the opening torque with the lapse of time is reduced and the sealing property of the liner is degraded. When the amount of the ethylene copolymer is too large and exceeds the above-mentioned range, not only the torque in the initial stage of sealing but also the torque at the time of opening is excessively increased and the object of imparting easy openability to the container closure cannot be attained. Further, it is sometimes difficult to mold the composition to a desirable liner shape.

In this invention, a lubricant and a conjugated diene-containing polymer are incorporated into a base resin comprising the above-mentioned crystalline polyolefin and lowly crystalline or amorphous ethylene copolymer. When a lubricant alone is incorporated into the abovementioned base resin, the lubricant immigrates to the surface portion of a liner at the liner molding step and the turning torque is inevitably reduced to an extremely low level in the initial stage of sealing. In contrast, when a lubricant is incorporated in combination with a conjugated diene-containing polymer into the base resin according to this invention, the conjugated diene-containing polymer acts as an agent of retaining the lubricating property. Namely, the diene-containing polymer has a function of gradually immigrating the lubricant into the surface portion while controlling rapid immigration of the lubricant in the initial stage of molding. As a result, according to this invention, it is possible to maintain the turning torque in the initial stage of sealing at a level suitable for sealing and also maintain the opening torque at a level assuring easy opening even after long time storage.

In this invention, as the lubricant, there is preferably employed a lubricant having such a property that when it is incorporated in an amount of 0.1% by weight into low density polyethylene, a friction coefficient lower than 0.45, especially lower than 0.25, is attained.

Suitable examples of the lubricant are described below, though lubricants that can be used in this invention are not limited to those exemplified below.

1. Aliphatic hydrocarbon lubricants

Liquid paraffin, white mineral oils of the industrial grade, synthetic paraffin, petroleum wax, petrolatam and odorless light hydrocarbons.

2. Silicones

Organopolysiloxanes.

3. Fatty acids and aliphatic alcohols (a) Higher fatty acids

Fatty acids obtained from vegetable and animal oils and fats and hydrogenation products thereof, each having 8 to 22 carbon atoms.

(b) Hydroxystearic acid (c) Linear aliphatic monohydric alcohols

Those having at least 4 carbon atoms, that are obtained by reducing animal and vegetable oils and fats or by cracking distillation of natural waxes.

(d) Dodecyl alcohol

4. Polyglycols

Polyethylene glycols having a molecular weight of 200 to 9500, polypropylene glycols having a molecular weight of at least 1000, and polyoxypropylene-polyoxyethylene block copolymers having a molecular weight of 1900 to 9000.

5. Amides and amines

Higher fatty acid amides, oleyl palmitamide, stearyl erucamide, 2-stearoamidoethyl stearate, ethylene-bis-fatty acid amides, N,N'-oleylstearyl-ethylene diamine, N,N'-bis-(2-hydroxyethyl)-alkyl amides having 12 to 18 carbon atoms in the alkyl group, N,N'-bis(hydroxyethyl)-lauroamide, reaction products of oleic acid with N-alkyl-trimethylene diamines having 16 to 18 carbon atoms in the alkyl group, fatty acid-diethanol amines, and distearic acid ester of di(hydroxyethyl)-diethylenetriamine monoacetate.

6. Fatty acid esters of monohydric and polyhydric alcohols n-Butyl stearate, methyl ester of hydrogenated rosin, di-n-butyl sebacate, 2-ethylhexyl sebacate, n-octyl sebacate, glycerin fatty acid ester, glyceryl lactostearyl, stearic acid ester of pentaerythritol, pentaerythritol tetrastearate, sorbitan fatty acid ester, polyethylene glycol fatty acid ester, polyethylene glycol monostearate, polyethylene glycol dilaurate, polyethylene glycol monooleate, polyethylene glycol dioleate, polyethylene glycol coconut fatty acid ester, polyethylene glycol tall oil fatty acid ester, ethanediol montanate, 1,3-butanediol diethylene glycol stearate and propylene glycol fatty acid ester.

7. Triglycerides and waxes

Hydrogenated edible oils and fats, cotton seed oil and other edible oils, linseed oil, palm oil, glycerin ester of 12-hydroxystearic acid, hydrogenated fish oils, beef tallow, spermaceti wax, montan wax, carnauba wax, bees wax, haze wax, esters of monohydric aliphatic alcohols with aliphatic saturated acids such as hardened whale oil lauryl stearate and stearyl stearate, and lanoline.

8. Alkali metal, alkaline earth metal, zinc and aluminum salts of higher fatty acids Various metal soaps.

9. Low-molecular-weight olefin resins

Low-molecular-weight polyethylene, low-molecular-weight polypropylene and oxidized polyethylene.

10. Fluorine resins

Polytetrafluoroethylene, tetrafluoroethylene/hexafluoropropylene copolymer, polychlorotrifluoroethylene and polyvinyl fluoride.

11. Others

Propylene glycol alginate, dialkyl ketone and acrylic copolymers (such as Modaflow manufctured by Monsanto Co.).

In this invention, it is preferred that a higher fatty acid amide, especially a fatty acid amide having 16 to 22 carbon atoms, be used as the lubricant. This preferred lubricant has an excellent lubricating effect to an olefin resin and it is excellent in the flavour-retaining property to a content of a container.

The lubricant is incorporated in an amount of 0.001 to 5% by weight, preferably 0.05 to 1.5% by weight, especially preferably 0.1 to 0.8% by weight, based on the base resin. When the amount of the lubricant is too small and below this range, the opening torque becomes too high and the opening operation is often difficult. When the amount of the lubricant is too large and exceeds the above range, the torque in the initial stage of sealing is too low and insufficient sealing is readily caused.

As the conjugated diene-containing polymer that is used as the lubricating property-retaining agent in this invention, there can be mentioned homopolymers of conjugated dienes and copolymers of conjugated dienes with other ethylenically unsaturated monomers. As the conjugated diene, there can be mentioned dienes represented by the following formula:

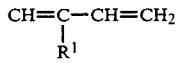

wherein $R^1$ stands for a hydrogen or halogen atom or an alkyl group having up to 4 carbon atoms, especially butadiene, isoprene and chloroprene. As the ethylenically unsaturated monomer, there can be mentioned, for example, aromatic vinyl monomers such as styrene, vinyl toluene and α-methylstyrene, ethylenically unsaturated carboxylic acids such as acrylic acid, methacrylic acid, maleic acid, maleic anhydride, fumaric acid, itaconic anhydride, crotonic acid and citraconic anhydride, esters, amides, hydroxyalkyl esters and aminoalkyl esters of these ethylenically unsaturated carboxylic acids, vinyl esters such as vinyl acetate, vinyl formate and vinyl propionate, ethylenically unsaturated nitriles such as acrylonitrile and methacrylonitrile, vinyl ethers such as methylvinyl ether and ethylvinyl ether, and vinyl halides such as vinyl chloride and vinylidene chloride. These monomers may be used singly or in the form of a mixture of two or more of them.

In order to attain the above-mentioned lubricating property-retaining effect, it is important that the conjugated diene-containing polymer used should contain at least 10% by weight, preferably at least 20% by weight, of conjugated diene units.

Suitable examples of the conjugated diene-containing polymer include synthetic and natural rubbers such as cis-1,4-polybutadiene, polyisoprene, styrene-butadiene copolymer rubbers, nitrile-butadiene copolymer rubbers and polychloroprene, and thermoplastic butadiene copolymers and thermoplastic isoprene copolymers. As the thermoplastic butadiene or isoprene copolymer, there are preferably employed styrene-butadiene or isoprene block copolymers and styrene-butadiene or isoprene-styrene block copolymers containing 15 to 40% by weight of butadiene or isoprene units.

In this invention, it is ordinarily preferred that the molecular weight of the conjugated diene-containing polymer be in the range of from 5,000 to 5,000,000.

In this invention, it is also important that the conjugated diene-containing polymer should be used in an amount of 1 to 15% by weight, preferably 1 to 10% by weight, especially preferably 2 to 7% by weight, based on the above-mentioned base resin. When the amount of the conjugated diene-containing polymer is too small and below this range, the opening torque in the initial stage of sealing is too low, and such troubles as insufficient sealing and leakage are readily caused. When the amount of the conjugated diene polymer is too large and exceeds the above range, immigration of the lubricant to the surface portion of the liner cannot be completely prevented, and the opening torque is often too high.

In this invention, by mixing the foregoing components at the above-mentioned mixing ratio, it is possible to attain such preferred torque characteristics that the opening torque in the initial stage of sealing is at least 1 Kg-cm, especially at least 2 Kg-cm, and the opening torque at the time of opening the container by a consumer is lower than 20 Kg-cm, especially lower than 13 Kg-cm.

Known additives may be incorporated into the olefin resin composition of this invention according to known recipes. For example, in order to color the liner or render the liner opaque, it is possible to incorporate a white pigment such as titanium dioxide, a coloring pigment such as carbon black, red iron oxide or Tartrazine lake or a filler such as calcium carbonate, talc, clay or barium sulfate. Further, an anti-blocking agent such as silica may be incorporated for preventing occurrence of the blocking phenomenon, and an antioxidant such as a stearic hindrance phenol may be incorporated to prevent thermal degradation at the step of processing the liner or the sterilization step.

The olefin resin composition of this invention may be formed into a liner by optional molding means. For example, the above-mentioned components are molten and kneaded, a predetermined amount of the melt is extruded on the inside of a shell of a container closure and the extrudate is mold-pressed under cooling, whereby a liner is directly formed on the container closure. This method is advantageous because a thick portion suitable for attaining a good sealing effect is readily formed in the peripheral part of the liner which is to be engaged with the mouth of a container. Of course, instead of this direct molding method, there can be adopted a method in which the metal of the olefin resin composition is preformed into a disc or the like, the preformed disc or the like is filled in the shell of a container closure and it is then heated and formed into a liner.

Moreover, there can be adopted a method in which the olefin resin composition of this invention is formed into a sheet by melt extrusion or roll molding, discs are punched out from the sheet and the discs are applied one by one to the interiors of shells of container closures, respectively. The sheet that is used for forming a liner according to this method may be either a single-layer sheet composed of the olefin resin composition of this invention or a multi-layer sheet in which at least the surface layer to be engaged with the mouth of a container is a layer composed of the olefin resin composition of this invention. Such multi-layer sheet may be prepared, for example, by bonding a layer composed of the olefin resin composition of this invention to a substrate such as paper, aluminum foil, a foamed sheet or a film of a polyester, e.g., Mylar, by such means as dry lamination, extrusion coating or co-extrusion.

A metal material constituting the shell of a container closure is, for example, a sheet of a light metal such as aluminum, a tin-plated steel sheet, a chromic acid electrolytically treated steel sheet (tin-free steel sheet) or other coated steel sheet. Such metal material may be coated with a known protecting paint, for example, an epoxy-phenolic paint.

Such metal sheet may easily be formed into a shell by such means as drawing, deep drawing, draw-ironing or pressing. The liner can easily be bonded to the interior of a closure shell through an adhesive layer containing oxidized polyethylene or acid-modified olefin resin.

In this invention, the closure shell may be formed of a plastic material.

This invention is applied to any of container closures of the type where opening of the closure is performed by relative rotation of the closure and container. For example, the container closure of this invention can be used as a screw cap, a pilfer-proof cap, a lag cap, a press-on twist-off cap, a twist crown cap or the like. Clamping or sealing of the container closure to the neck of a container can be performed by the roll-on method (screwing by a thread roller), the press-on method, the screw-on method or the like.

This invention will now be described in detail by reference to the following Examples that by no means limit the scope of the invention.

EXAMPLE 1

Figure 2:
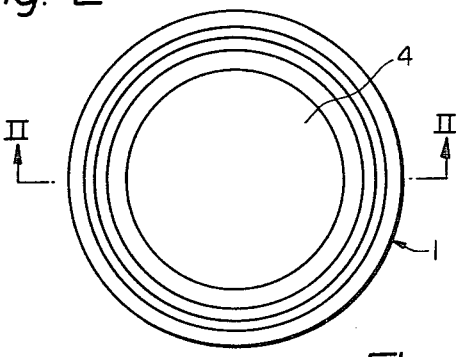
FIG. 2 is a plan view illustrating the inside of a pilfer-proof cap having a liner, prepared in Example 1.
Figure 3:
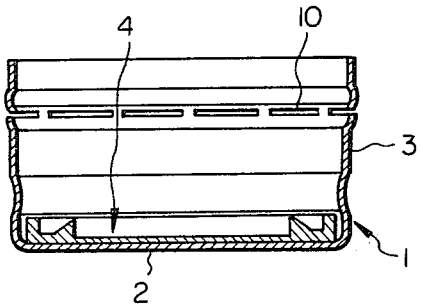
FIG. 3 is a view illustrating the secion taken along the line III—III in FIG. 2.

An adhesive paint comprising 10 parts by weight of an epoxy resin, 10 parts by weight of a urea resin, 20 parts by weight of oxidized polyethylene and an organic solvent was roll-coated on an aluminum sheet having a thickness of 0.25 mm and the aluminum sheet was heated at 200° C. for 10 minutes to form a coated aluminum sheet. A cap closure was press-formed from this sheet so that the coated surface was located on the inside. The cap closure was heated at about 150° C. by a high frequency heater and a thermoplastic resin composition indicated in Table 1 was extruded from an extruder and the molten extrudate was applied to the inside of the cap closure by a rotary blade, and the applied melt was immediately pressed to form a cap having a liner. The weight of the liner-constituting resin was 0.5 g, and the shapes of the so formed liner and cap closure were as shown in FIGS. 2 and 3.

A glass container having an inner full capacity of 110 cc and a mouth to be engaged with the cap was charged with 100 cc of a carbonated drink (having a gas pressure corresponding to 4 volumes), and the above-mentioned cap, which had been allowed to stand still for about 1 week from the time of preparation, was clamped to the filled glass vessel. Within two hours from the point of clamping, vibrations having an acceleration of 1 G and an amplitude of 3 mm were given to the container for 30 minutes in the lateral direction and for 30 minutes in the longitudinal direction.

The so prepared filled container was subjected to the following tests.

When 24 hours had passed from the point of filling of the carbonated drink, the torque necessary for opening the cap was measured by a torque meter, and after the filled container had been stored in the vertical position for 1 month at a temperature of 20° C. and a relative humidity of 30%, the opening torque was similarly measured. Further, after the filled container had been stored in the vertical position for 1 month under the above conditions, the easiness of opening was examined by a panel of 50 men, and the easy openability was evaluated based on the proportion of the men judging that the cap could easily be opened. Further, liquid leakage was examined after the filled container had been stored in the vertical position for 1 month under the above conditions.

Obtained test results are shown in Table 1.

TABLE 1

| | Composition (% by weight) of Liner | | | Opening Torque (Kg-cm) | | | |
|---|---|---|---|---|---|---|---|
| Sample | Base Resin (A) (LDPE-EPDH) | Content of SIS to (A) | Content of $L_1$ to (A) | just after filling | after 1 month's storage | Leakage Ratio (%) | Easy Openability (%) |
| comparison 1 | 99-1 | 10 | 0.1 | 1.4 | 9.9 | 29.6 | 100 |
| sample 1 | 95-1 | 10 | 0.1 | 3.7 | 9.5 | 0 | 100 |
| sample 2 | 80-20 | 10 | 0.1 | 3.9 | 8.7 | 0 | 100 |
| sample 3 | 60-40 | 10 | 0.1 | 4.5 | 9.2 | 0 | 90.5 |
| sample 4 | 40-60 | 10 | 0.1 | 4.8 | 12.1 | 0 | 84.0 |
| comparison 2 | 20-80 | 10 | 0.1 | 6.7 | 32.0 | 10.2 | 2.8 |
| comparison 3 | 70-30 | 0 | 1 | 0.8 | 21.5 | 59.3 | 78.6 |
| sample 5 | 70-30 | 1 | 1 | 2.8 | 8.5 | 0 | 98.2 |
| sample 6 | 70-30 | 10 | 1 | 3.5 | 8.8 | 0 | 100 |
| sample 7 | 70-30 | 15 | 1 | 5.9 | 10.2 | 0 | 100 |
| comparison 4 | 70-30 | 30 | 1 | 21.0 | above 45 | 0 | 0 |
| comparison 5 | 80-20 | 5 | 0 | 30.1 | above 45 | 0 | 0 |
| sample 8 | 80-20 | 5 | 0.005 | 2.0 | 11.2 | 0 | 90.5 |
| sample 9 | 80-20 | 5 | 0.05 | 3.8 | 8.6 | 0 | 100 |

TABLE 1-continued

| Sample | Composition (% by weight) of Liner: Base Resin (A) (LDPE-EPDH) | Content of SIS to (A) | Content of $L_1$ to (A) | Opening Torque (Kg-cm): just after filling | after 1 month's storage | Leakage Ratio (%) | Easy Openability (%) |
|---|---|---|---|---|---|---|---|
| sample 10 | 80-20 | 5 | 0.5 | 4.0 | 9.2 | 0 | 100 |
| sample 11 | 80-20 | 5 | 1.0 | 4.0 | 7.8 | 0 | 100 |
| comparison 6 | 80-20 | 5 | 10.0 | 0.5 | 5.2 | 68.5 | 100 |

Note

LDPE: low density polyethylene having a melt index of 8.5, a density of 0.918 a degree of crystallization of 60%

EPDM: ethylene-propylene-diene copolymer having a propylene content of 28% by weight and a degree of crystallization lower than 5%

SIS: styrene-isoprene-styrene block copolymer having an isoprene content of 62% by weight, a styrene portion molecular weight of 30000 and an isoprene portion molecular weight of 16000

$L_1$: oleic amide (lubricant)

From the results shown in Table 1, it will readily be understood that caps according to this invention are excellent in practical properties such as easy openability and sealing property. When the content of EPDM is extremely low in the base resin, the sealing property is poor and when the content of EPDM is extremely high in the base resin, the opening is difficult and the sealing property is poor because the liner cannot be formed into a satisfactory shape. When the content of the conjugated diene-containing polymer (SIS) is too low, the opening torque just after filling is low and therefore, leakage of the content liquid is caused even under mild vibrations of 1 G. When the content is too high and 30%, the opening becomes impossible. When the amount of lubricant is too large, the opening torque just after filling is very low and leakage is caused under vibrations. The lubricant used in this Example was found to have such an effect that the dynamic friction coefficient of LDPE alone, which was 0.55, was reduced to 0.21 when the lubricant was incorporated in an amount of 0.1% by weight into LDPE.

EXAMPLE 2

Liners were prepared from resin compositions shown in Table 2. In the base resin (A), 80 parts by weight of the crystalline polyolefin was mixed with 20 parts by weight of the lowly crystalline or amorphous polyolefin. The conjugated diene-containing copolymer and lubricant were incorporated in amounts of 7% by weight and 0.5% by weight, respectively, based on the base resin (A).

A homogeneous resin composition comprising these components at the above mixing ratio was formed into a sheet having a thickness of 0.5 mm, and circular discs were punched off from the sheet. The disc was fitted in the interior of a cap shell 1 shown in FIG. 3, heated at about 160° C. and pressed by a cold punch to form a cap having a liner. The so prepared caps were allowed to stand still for 1 week and used for the tests described below.

Figure 4:
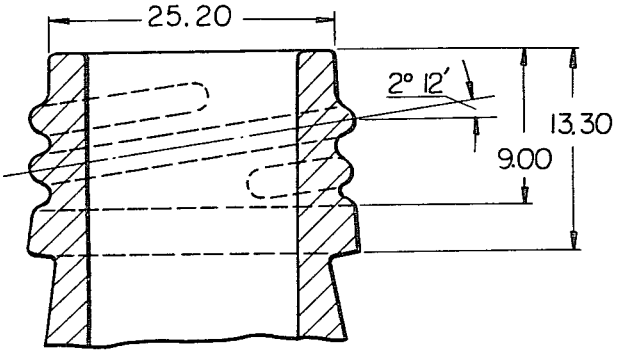
FIG. 4 is a sectional view of a bottle mouth used at the test of Example 2.

In the same manner as described in Example 1, a carbonated drink was filled in containers as shown in FIG. 4 and the filled containers were sealed with the above-mentioned caps. The open torque was measured after the lapse of a predetermined period. Fifty caps were tested with respect to each sample and a mean value was calculated. Obtained results are shown in Table 2.

From the results shown in Table 2, it will readily be understood that each of samples according to this invention have a good sealing property and a good easy openability. Among these samples, those prepared by using an ethylene-propylene or ethylene-butene-1 copolymer having a specific copolymerization ratio as the lowly crystalline or amorphous polymer of the base resin (A) and a diene-containing block copolymer as the lubricating property-retaining component are especially excellent in these practical properties. The lubricant $L_2$ and $L_3$ used in this Example showed dynamic friction coefficients of 0.32 and 0.01, respectively, when determined in the same manner as described in Example 1.

TABLE 2

| Sample | Liner Constituents: Base Resin (HC-LC) | Conjugated Diene-Containing Polymer | Lubricant | Opening Torque (Kg-cm): Just after filling | after 1 day | after 15 days | after 30 days | after 60 days |
|---|---|---|---|---|---|---|---|---|
| comparison 7 | $LDPE\text{-}EB_1$ | SBS | $L_2$ | 1.0 | 2.8 | 2.8 | 3.3 | 3.9 |
| sample 12 | $LDPE\text{-}EB_2$ | SBS | $L_2$ | 3.1 | 6.5 | 7.8 | 9.6 | 9.6 |
| sample 13 | $LDPE\text{-}EB_3$ | SBS | $L_2$ | 5.8 | 7.1 | 7.9 | 8.2 | 9.0 |
| comparison 8 | $LDPE\text{-}EP_1$ | SBS | $L_2$ | 0.9 | 1.4 | 3.2 | 2.5 | 3.9 |
| sample 14 | $LDPE\text{-}EP_2$ | SBS | $L_2$ | 3.8 | 7.2 | 7.5 | 8.0 | 8.1 |
| sample 15 | $LDPE\text{-}EP_3$ | SBS | $L_2$ | 5.5 | 6.8 | 7.0 | 9.7 | 9.8 |
| sample 16 | SBS | $L_2$ | 8.4 | 7.5 | 12.1 | 20.5 | 25.6 | |
| $LDPE\text{-}EP_4$ | | | | | | | | |
| sample 17 | LDPE-EVA | SBS | $L_2$ | 7.8 | 10.5 | 17.9 | 25.9 | 27.8 |
| sample 18 | LDPE-EA | SBS | $L_2$ | 1.9 | 2.1 | 3.0 | 3.2 | 2.9 |
| sample 19 | $LDPE\text{-}EP_3$ | SIS | $L_3$ | 3.5 | 6.2 | 7.1 | 8.9 | 8.9 |
| sample 20 | $LDPE\text{-}EP_3$ | NR | $L_3$ | 7.1 | 11.6 | 20.5 | 25.4 | 25.1 |
| sample 21 | $LDPE\text{-}EP_3$ | BR | $L_3$ | 9.2 | 10.0 | 18.3 | 23.6 | 24.4 |

TABLE 2-continued

| Sample | Liner Constituents: Base Resin (HC-LC) | Conjugated Diene-Containing Polymer | Lubricant | Just after filling | Opening Torque (Kg-cm): after 1 day | after 15 days | after 30 days | after 60 days |
|---|---|---|---|---|---|---|---|---|
| sample 22 | LDPE-$EP_3$ | SBR | $L_3$ | 6.9 | 9.7 | 15.1 | 17.0 | 17.8 |

Note
HC: crystalline polyolefin
LC: lowly crystalline or amorphous copolymer
$EB_1$: ethylene-butene-1 copolymer having a butene-1 content of 5.4% by weight and a degree of crystallization of 57%
$EB_2$: ethylene-butene-1 copolymer having a butene-1 content of 11.5% by weight and a degree of crystallization of 10.5%
$EB_3$: ethylene-butene-1 copolymer having a butene-1 content of 21.6% by weight and a degree of crystallization of less than 5%
$EP_1$: ethylene-propylene copolymer having a propylene content of 4.8% by weight and a degree of crystallization of 62%
$EP_2$: ethylene-propylene copolymer having a propylene content of 15.2% by weight and a degree of crystallization of 18%
$EP_3$: ethylene-propylene copolymer having a propylene content of 27.4% by weight and a degree of crystallization of less than 5%
$EP_4$: ethylene-propylene copolymer having a propylene content of 45.0% by weight and a degree of crystallization of 0%
EVA: copolymer comprising 80% by weight of ethylene and 20% by weight of vinyl acetate and having a degree of crystallization of less than 5%
EA: ethylene-acrylic acid copolymer having a degree of crystallization of 15%
LDPE: low density polyethylene having a melt index of 4.5, a density o 0.921 and a degree of crystallization of 68%
SBS: styrene-butadiene-styrene block copolymer (Cariflex TR1102 manufactured by Shell Chemicals)
SIS: styrene-isoprene-styrene block copolymer (Cariflex TR1107 manufactured by Shell Chemicals)
NR: natural rubber (pale crepe No. 1)
BR: cis-1,4-polybutadiene rubber
SBR: styrene-butadiene copolymer rubber having a styrene content of 25% by weight
$L_2$: lauric acid ethylene-bis-amide
$L_3$: erucic amid

What we claim is:

1. A container closure comprising a closure shell and an easily openable liner for sealing bonded to the interior of said closure shell, said liner being composed of a composition comprising
   (I) a base resin consisting of
      (a) 95 to 30% by weight of a highly crystalline polyolefin and
      (b) 5 to 70% by weight of a lowly crystalline or amorphous ethylene polymer selected from the group consisting of a copolymer of ethylene with propylene or butene-1 and a terpolymer of ethylene with propylene and a non-conjugated diene.
   (II) a lubricant in an amount of 0.001 to 5% by weight based on said base resin, and
   (III) a polymer containing at least 10% by weight of a conjugated diene in an amount of 1 to 15% by weight based on said base resin.

2. A container closure as set forth in claim 1 wherein the crystalline polyolefin is low density polyethylene.

3. A container closure as set forth in claim 1 or 8 wherein the ethylene-propylene copolymer of (I) (b) comprises 95 to 40 mole % of ethylene and 5 to 60 mole % of propylene.

4. A container closure as set forth in claim 1 or 8 wherein the terpolymer of (I) (b) comprises 95 to 40 mole % of propylene, 5 to 60 mole % of ethylene and 1 to 5 mole % of a non-conjugated diene.

5. A container closure as set forth in claim 1 or 2 wherein the lubricant has such a lubricating property that when the lubricant is incorporated in an amount of 1% by weight into low density polyethylene, the dynamic friction coefficient of the resulting mixture is lower than 0.45.

6. A container closure as set forth in claim 1 or 8 wherein the lubricant is a fatty acid amide having 16 to 22 carbon atoms.

7. A container closure as set forth in claim 1 or 2 wherein the conjugated diene-containing polymer of (III) is a styrene-butadiene block copolymer, styrene-isoprene block copolymer, styrene-butadiene-styrene block copolymer or styrene-isoprene-styrene block copolymer having a butadiene or isoprene content of 15 to 40% by weight.

* * * * *

UNITED STATES PATENT AND TRADEMARK OFFICE

CERTIFICATE OF CORRECTION

PATENT NO. : 4,256,234

DATED : March 17, 1981

INVENTOR(S) : Fumio Mori; Junichi Itsubo; Gunji Matsuda; Shigeru Nagashima; and Kozo Nakamura.

It is certified that error appears in the above—identified patent and that said Letters Patent is hereby corrected as shown below:

In the claims:

Claim 3, line 1, delete "8" and insert --2--

Claim 4, line 1, delete "8" and insert --2--

Claim 6, line 1, delete "8" and insert --2--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*